United States Patent [19]

Rut

[11] 4,041,755

[45] Aug. 16, 1977

[54] METHOD AND DEVICES FOR FORGING SINGLE CRANK THROWS OF SEMI-BUILT UP CRANKSHAFTS

[75] Inventor: Tadeusz Rut, Poznan, Poland

[73] Assignee: Instytut Obrobki Plastycznej, Poznan, Poland

[21] Appl. No.: 661,518

[22] Filed: Feb. 26, 1976

[30] Foreign Application Priority Data

Mar. 15, 1975 Poland ..... 178817

[51] Int. Cl.[2] ..... B21K 1/08

[52] U.S. Cl. ..... 72/353; 72/356; 29/6

[58] Field of Search ..... 29/6; 72/353, 357, 399, 72/356

[56] References Cited

U.S. PATENT DOCUMENTS

| | | | |
|---|---|---|---|
| 2,827,685 | 3/1958 | Cleghorn | 29/6 |
| 2,891,299 | 6/1959 | Robra | 29/6 |
| 3,650,143 | 3/1972 | Ruget | 29/6 |

*Primary Examiner*—Lowell A. Larson

[57] ABSTRACT

A method and an apparatus for forging single crank throw elements comprising upsetting a rough piece in a ring-segment compression die to form a blank having opposite shoulder portions with a narrowing connection portion, the connection portion narrowing from both shoulder portions to a central narrowest section. The blank is placed in a die with the shoulder portions resting against inclined surfaces of the die such that clear spaces are formed between the shoulder portions and the inclined surfaces. A force is applied against the narrowing connection portion in a direction perpendicular thereto to deform the narrowing connection portion in a direction to fill the clear spaces while concurrently upsetting forces are applied to the shoulder portions in a direction perpendicular to the direction of the force applied to the connection portion. The upsetting forces are applied by laterally driving die holder elements towards one another by an inclined wedged element which is driven by a press. The die holder elements are supported by articulated links pivotably mounted on fixed structure.

7 Claims, 24 Drawing Figures

METHOD AND DEVICES FOR FORGING SINGLE CRANK THROWS OF SEMI-BUILT UP CRANKSHAFTS

The invention relates to a method and apparatus for producing single crank throws consisting of two crank arms linked by a crank-pin, destined for the production of semi-built up crankshafts, for high-power engines.

All prior art methods of making single crank throws may be in principle divided into three groups, namely: ring forging methods, bend forging methods and, finally die forging methods. These three groups of methods are discussed briefly herebelow.

In a ring forging method, an ingot, both extreme parts of which are cut-off, serves as the forging stock; the ingot is upset and, by means of a mandrel, a central hole is made forming a ring. This ring is forged on the mandrel to have an elliptic elongation. Crank-pins are shaped at the ends of the ellipse and the righ is cut along its shorter axis to provide two single crank throws which undergo a final forming. While this method allows obtaining products featuring a regular metal flow within the crank-pin, a central part of the material is lost when making an opening in the ring. There is also a danger of blowholes remaining in the material and unevenness of metal structure on the ring inner side. The forging process itself is very complicated and tough.

The method of forging single crank throws by bending, consists in upsetting an ingot after rejecting extreme parts and then in drawing down and shaping a rectangular section. In the next operation, the extreme parts of an elongated blank are squeezed so that they are wider than a central part; finally the central part is bent by 180° giving a raw forging of a single crank throw. This method allows obtaining a satisfactory metal flow in crank throws but it does not guarantee the elimination of blowholes in the metal. It is also difficult to obtain the final shapes of the crank throw and some significant stock allowances are necessary which are removed during the following stages of the process.

The method of die forging single crank throws, consists in upsetting an ingot after separating extreme parts; that a block of cube shape is formed from this ingot. This cube, is introduced into a die, at the top, and forged to a single crank throw; then a punch, as wide as a crank-pin is long, and having a half-round recess at the bottom, is introduced from the top into a middle strip of stock. This punch causes the stock to joggle downwards and to extrude outside. Thereby a very accurate formation of a forged outer surface is obtainable, however there is no way to avoid cutting of the punch on inner parts of material of the crank arms which evidently leads to an irregular metal flow in the product. Also some significant flashes take place in the crank-pin. A great force is required to form a crank-throw.

A device for shaping crank throw arms, used in a bend forging method is known from the patent specification of the German Federal Republic Pat. No. 1.101 108. The device is used for upsetting and it consists of two die-halves and a cover having, after their assembly, an inner impression corresponding to the shape of one arm of a crank throw blank. Die halves have a conical outer surface and are connected with each other by means of a ring having a conical inner surface. The die halves rest at their bottom on a ring base. This device allows forming only one half of a blank crank throw during one working stroke of a press. In order to shape another half of a blank crank throw, a semi-finished product is removed from the device, reversed by 180°, and mounted again in the device and shaped again during a second working stroke.

There are generally known devices used to forge complete crankshafts, i.e., having a few crank throws joined by bearing journals of a monolithic structure. In these devices, the crank throws are shaped by upsetting and bending at the same time so that a crankshaft blank is fastened in a forging attachment by places which are product bearing journals, while a rod section between them undergoes upsetting and, at the same time, bending, by means of a punch. In these devices, upsetting dies are driven through inclined slideways elements, as for instance in devices designed by the Ateliers et Forges de la Loire in France/British patent specification No. 628519/, or the dies are driven through articulated links designed by T. Rut/British patent specification No. 1,079,255/.

It is characteristic, when forging crankshafts by these methods, that in the first phase of shaping, bending takes place and at the same time rod sections are upset, destined as material for crank arms. In view of the above, no joggling of the crank-pin material in relation to a crank arm material takes place in this phase. Forces directed contrariwise to the direction of a bending punch thrust, do not act on crank arms. Material is supported on two crankshaft main bearing journals only, between which a crank is upset and bent.

An object of invention is to provide a method for forging single crank throws, consisting of two crank arms joined by a journal, in which the products have a regular metal flow, good surface quality and small allowances, thereby limiting the machining to a minimum. The invention also seeks the production of crank throws for small thrust of a press in relation to the size of a product.

According to the invention an ingot is first cogged to homogenize the structure of material and to close cavities. Thereby a rough piece of elongated shape is obtained. From this rough piece a blank is made, causing a two-sided upset of the rough piece so that two extreme flange shoulders are formed, connected by a narrowing portion; parts directed to the central narrowing portion have the shape of a frustum of cone or pyramid or the like; a part of circumferential surface of each blank extreme part, after preliminary formation according to the required shape of the crank arms, rests on oblique surfaces of a die with a free space between them; a punch presses against the narrowing portion perpendicular to the axis of the narrowing portion, to joggle it in a known way to fill the empty space between supporting oblique surfaces; at the same time, as the crank-pin is joggled, the formed crank throws are squeezed from two sides in a direction parallel to the crank pin axis. As a result of the above, in the method according to the invention the upsetting takes place twice: first, when shaping the blank; second, when shaping the finished single crank throw. This contributes to a significant closing of cavities contained in the stock.

It has to be mentioned that a blank, made according to the invention, having two upset extreme parts connected by a narrowing portion only requires a rotational symmetry around the axis of the narrowing portion.

The method, according to the invention and the equipment used therein, will be discussed in detail with reference to the annexed drawing which shows examples of the realization of the invention not limiting its range.

In the drawings, FIGS. 1–10 are examples of the shapes of five blanks used for the production of single crank throws and each of blanks is shown in a side view and in a section perpendicular to the axis.

FIG. 11 diagrammatically shows the shaping method of a crank throw, in a side view partly in a section.

FIG. 13 shows a finished blank of a crank throw in a side view, while

Figure 1:
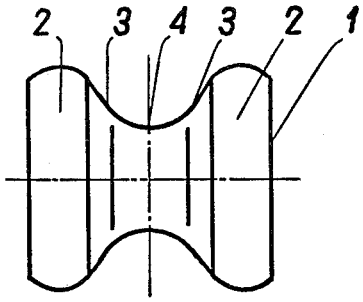

The procedure according to the invention is the following: a rough piece, not shown in the drawing, of an arbitrary section, is first upset to form a blank having two wide extreme parts connected by a narrowing portion. A few examples of making such blanks are shown in FIGS. 1–10. Each of these blanks has two flat front surfaces 1 on extreme parts 2. Parts 3 of a blank, directed towards a central narrowing portion 4, have a shape approximately of a frustum of a cone or pyramid.

Figure 11:
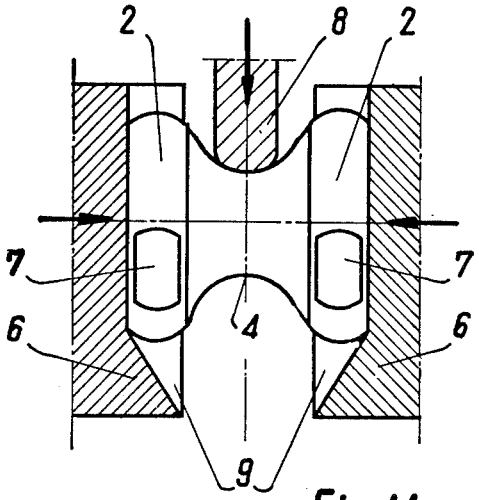
Figure 12:
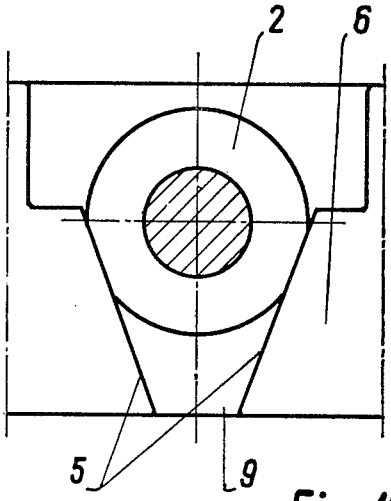
FIG. 12 shows a blank abutting against the die in a cross section perpendicular to the axis.

As shown in FIGS. 11 and 12, this type of blank is abutted with its extreme parts 2 against oblique surfaces 5 of two dies 6 and 6'. The surface of the blank which initially contact surfaces 5 of the dies at the beginning of a working stroke are designated by numeral 7.

Figure 13:
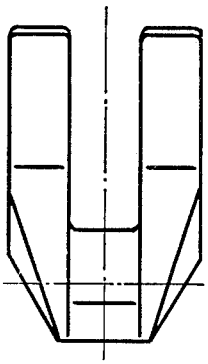
Figure 14:
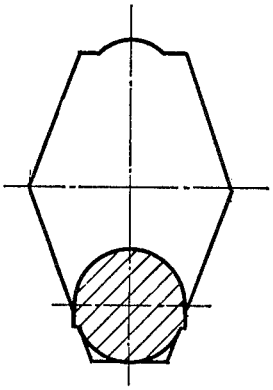
FIG. 14 shows the same blank in a cross-section perpendicular to the axis of the crank-pin.

A punch 8 acts from above on the thus supported blank, against the narrowing portion 4. Concurrently with the movement of the punch 8 downwards, the dies 6 and 6'approach each other. The direction of the movement of the dies is thus perpendicular to the direction of the punch 8. The material of the narrowing portion of the blank is joggled or deformed downwards during the approach of the dies, to each other. Thereby, this material is forced into a free space 9 at the oblique surfaces 5 of each die 6 and 6'. The material forced into the space 9 mainly comes from conical parts 3 of the blank. In this way a crank throw, shown in FIGS. 13 and 14, is formed. The upper part of the crank throw arms is shaped by means of wedge die inserts, as will be discussed further on. Obviously, these inserts may have other than a wedge-like shape, depending on the desired profile of the crank throw arms.

Figure 2:
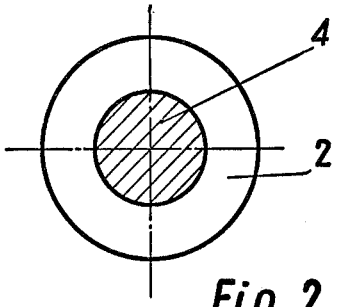
Figure 3:
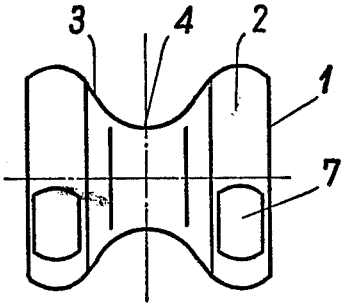
Figure 4:
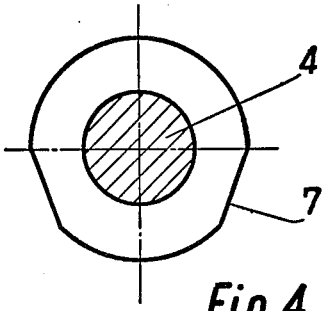
Figure 5:
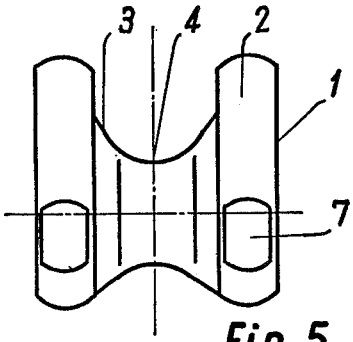
Figure 6:
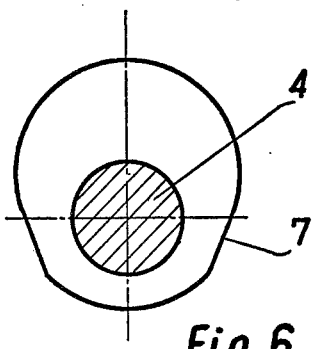
Figure 7:
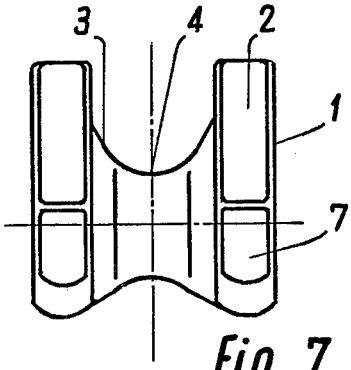
Figure 8:
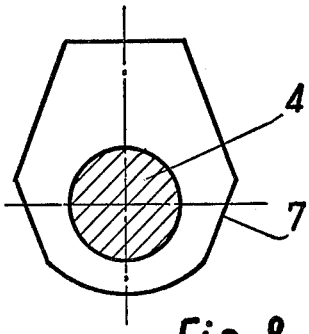
Figure 9:
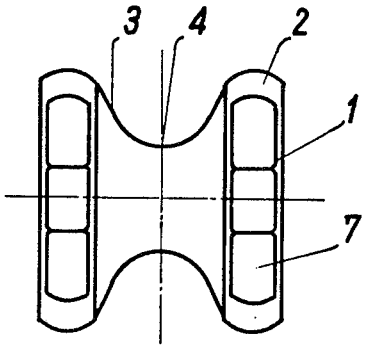
Figure 10:
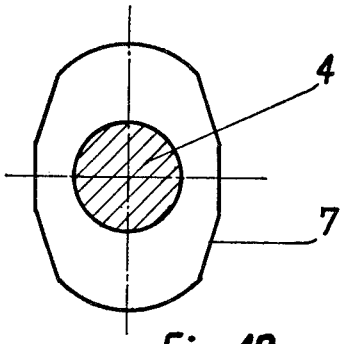

A device for upsetting blanks according to FIGS. 1 and 2 is shown in FIGs. 15 – 18. It consists of a fixing ring 10 on which rests a die insert in the form of a ring divided into three segments 11. The segments have oblique outer surfaces co-acting with oblique inner surfaces of a ring casing 12.

The inclination of these oblique surfaces is greater than the angle of self-braking. Casing 12 is provided with arrester hooks 13 engaging the fixing ring 10 after closure of the die.

Figure 16:
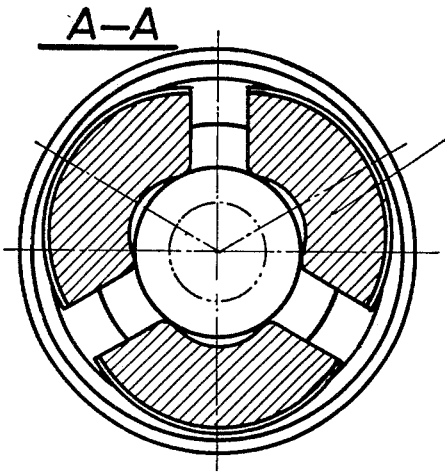
FIG. 16 shows the same device in a section then along line A—A in FIG. 15.
Figure 15:
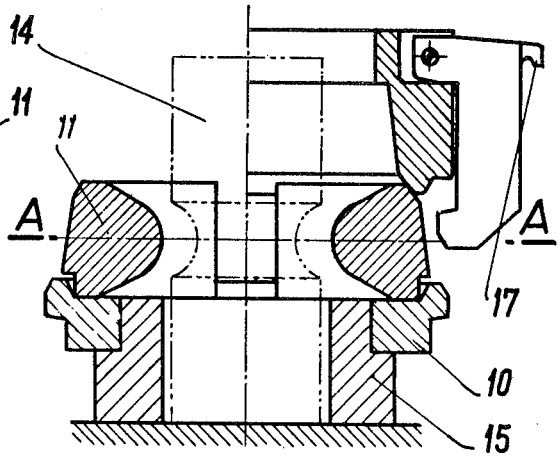
FIG. 15 shows an axial section of an open device for upsetting blanks.
Figure 17:
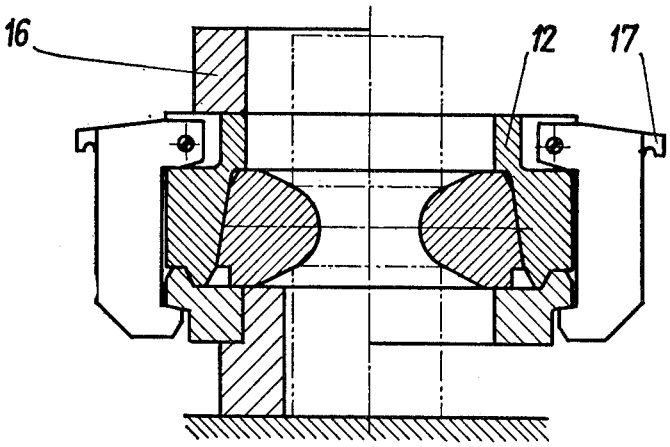
FIG 17 shows the same device closed, in an axial section.

This device operates in the following way: as shown in FIGS. 15 and 16, at ring 10 is put on a spacing sleeve 15 and, with the casing 12 removed, segments 11 are mounted outside the ring 10. A rough piece 14 is inserted between segments 11. The piece has in this case the shape of a roll contracted in the middle. Then the casing 12 is lowered, under the thrust of a press through a sleeve 16. This brings about tightening of segments 11 around the rough piece 14. At the bottom extreme position of the casing 12, the arrester hooks 13 engage the rim of ring 10. This is shown in FIG. 17.

Figure 18:
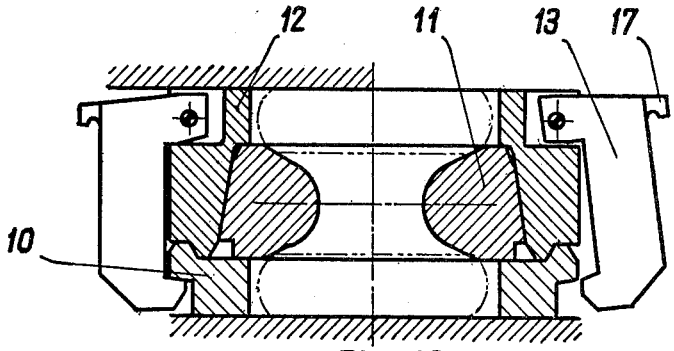
FIG. 18 shows the device after upsetting a blank, during its opening, in an axial section.
Figure 19:
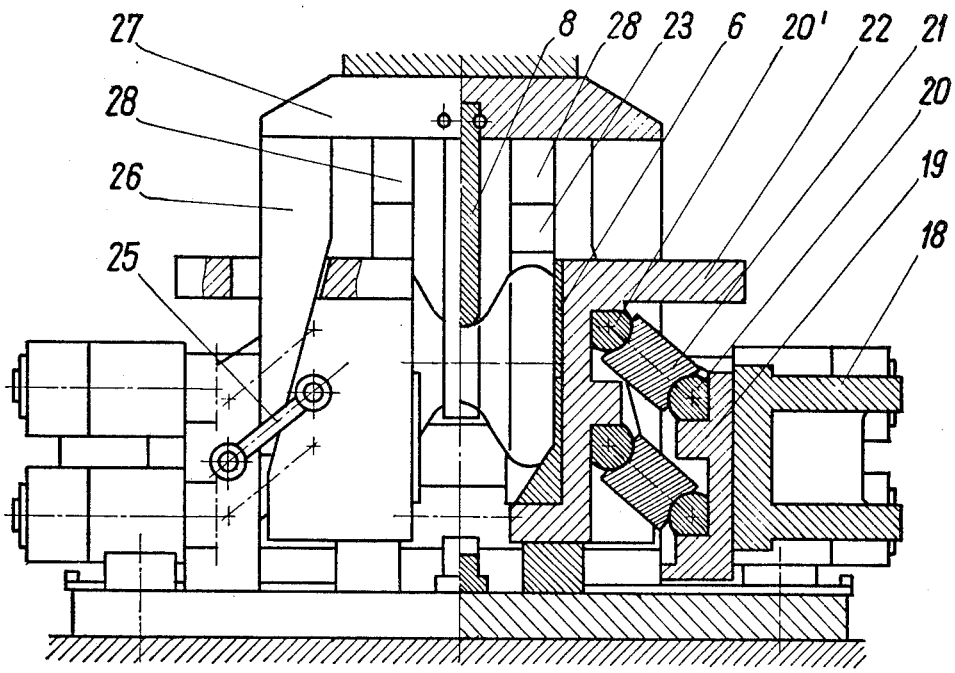
FIG. 19 is a side view and lengthwise half-section of a crank throw forging device at the beginning of a working stroke.

After closing the hooks 13, the sleeves 15 and 16, are removed and the rough piece in the device is upset axially by means of a press (FIG. 18). A blank is obtained of the form shown in FIGS. 1 and 2 or FIGS. 3 and 4. The hooks 13 are opened by hitching a rope onto catches 17 and lifting them, for instance, by means of a crane. The device shown in FIGS. 19 – 22 is used to forge the above described and two-sided upset blanks into single crank throws. It is constructed in the following way: a body 18 is rigidly secured to a press table. Inside this body are housed symmetrically two counter-running working units having similar structure. Against two opposite inner walls of this body are abutted directly (or through spacers not shown in the drawing) bearing mounts 19. Two semi-cylindrical bearing members 20 are fastened to each of the mounts. Against the members 20 abut articulated links 21 positioned obliquely relative to a horizontal plane and against these links 21 abut, in turn, bearing members 20' fastened to holders 22 of the dies 6. Right and left parts of the body 18 are inter-connected by roller braces 24. Between bearing mounts 19 and die holders 22 are mounted braces 25 preventing the links 121 from falling between bearing members 20 and 20'.

Oblique rear surfaces of the casings 22 co-act with wedge elements 26 driven by a press ram 27. The punch 8 is fastened to the press ram 27.

Figure 20:
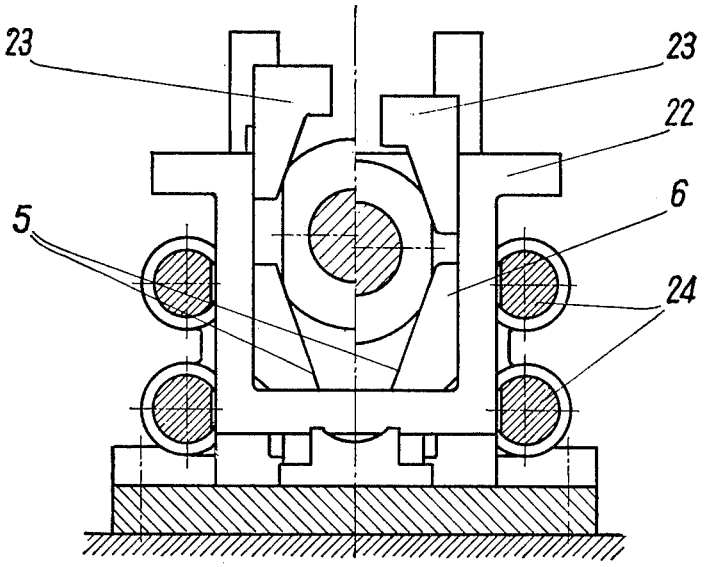
FIG. 20 is a cross-section of a part of the device according to FIG. 19; the left half of the drawing showing the position of die inserts and the blank before starting a working stroke, while the right half of the drawing illustrates the position during the working stroke before joggling a crank-pin.
Figure 21:
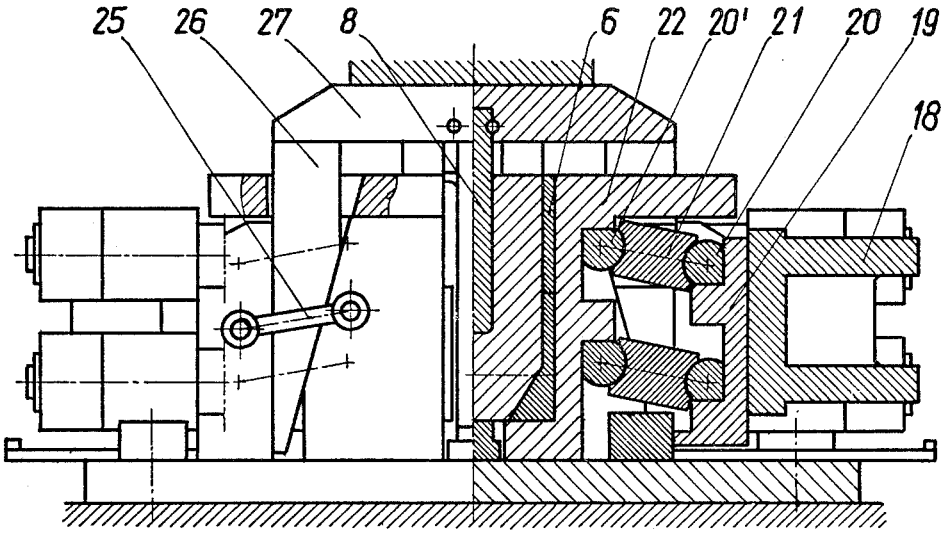
FIG. 21 shows a single crank throw forging device after a working stroke in side view and in lengthwise section.
Figure 22:
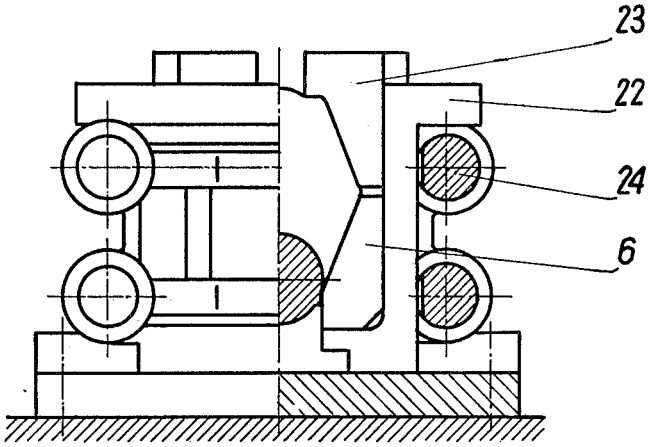
FIG. 22 shows a part of the device of the device in FIG. 21 in front view and partly in half cross-section.

As shown in FIGS. 20 and 21, each of the holders 22 houses the dies 6 and upper wedge die inserts 23.

The device, according to FIGS. 19 – 22, operates as follows: the press ram 27 is lifted, and the right and left holders 22 of the dies are opened in the direction of walls 18. A blank is placed on surfaces 5 of the dies 6 and 6' situated in the right and left holders 22 and a pair of wedge inserts 23 are introduced from the top at each side in the manner shown in FIG. 20 (left half of the drawing). Blocks 28 are placed on the inserts 23 and the press is driven in motion. The press ram is stopped when the die inserts and blank are in the position shown in FIG. 20 at the right side of the drawing. Then the blocks 28 are removed from under the ram and the press is restarted. The punch 8 presses against the narrowing portion 4 of the blank and causes its joggling downwards. Together with the narrowing portion 4, are conical parts 3 are joggled to a certain degree as well.

The joggled material fills the free space between opposite oblique surfaces 5 of the dies 6 and 6'. The upsetting of the material, caused by the holders 22, moving towards each other, takes place at the same time as the joggling. Into the upset material the wedge die inserts 23 are forced. At the end of the working stroke, both the crank-pin and the single crank throw arms are fully shaped; this shown in FIG. 22.

The sizing of the arm upper parts by means of the die inserts 23 may by performed also during a repeated motion of a press ram. For this purpose the fixing of the punch 8 has to be released from the ram 27.

Figure 23:
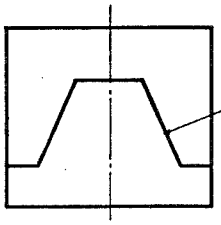
FIG. 23 is a punch for sizing the upper parts of the crank throw arms in side view.
Figure 24:
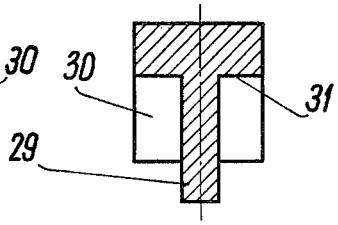
FIG. 24 is a lengthwise section of the punch according to FIG. 23.

The upper part of crank throw arms may be sized also after removing the punch 8. Such sizing is carried out by means of a punch shown in FIGS. 23 and 24. An element 29 is inserted between the crank throw arms in place of the punch 8. The surfaces 30 and 31 form the upper part of the crank throw during the pressing of the press ram onto the sizing punch. Attention should be drawn now to some new features of the mechanisms used of the drive transmission. The device, according to the invention, uses a two-stage force transmission of the press ram to produce the transverse force causing the closure of die holders 22. The first stage of transmission takes place on a wedge element 26. The transmission of this element is invariable along the entire length of a working stroke. The second stage of the transmission takes place on an articulated connection by means of links 21, applied between stationary body 18 and moving die holders 22. This transmission changes during the working stroke and the transmission ratio is compatible with a tangent function of an angle between the direction of press force action and a longitudinal axis of links 21. This sort of associating two transmissions having a different performance characteristic, enables selection to the kind of movement of the forging tools in accordance with actual needs.

It has to be mentioned that in the last stage of shaping, wherein the greatest resistance of material takes place, the device has, according to the invention, the greatest ratio of the press force transmission on the upsetting force, which enables forming large products in presses of a relatively small thrust.

Another feature of the drive transmission mechanisms is the fact that the punch 8, and the shaped material as well, are both elements transmitting a part of the press thrust force to the dies 6 and their holders 22 causing their motion relative in a direction transverse to the motion of ram 27. That is why wedge elements 26 are to a great extent relieved, because they transmit only a part of the force required to close die holders 22.

What I claim is:

1. A method of forging single crank throw elements comprising upsetting a rough piece to form a blank having opposite shoulder portions with a narrowing connection portion, the connection portion narrowing from both shoulder portions to a central narrowest section, placing said blank in a die with said shoulder portions resting on inclined surfaces of the die such that clear spaces are formed between the shoulder portions and the inclined surfaces, applying a force against the narrowing connection portion in a direction perpendicular thereto to deform said connection portion in a direction to fill said clear spaces and concurrently applying upsetting forces on said shoulder portions in a direction perpendicular to the direction of the force applied to said connecting portion.

2. Apparatus for forging single crank throw elements comprising two opposed die holders slidably mounted for movement towards and away from one another, obliquely positioned articulated links having first ends pivotably coupled to said holders and second ends pivotably coupled to fixed structure, said holders having inclined actuation surfaces, and wedge-shape elements bearing against said actuation surfaces and displaceable in a direction perpendicular to the direction of movement by the die holders to displace the die holders towards one another to upset a blank in the holders.

3. Apparatus as claimed in claim 2 wherein said wedge-shaped elements are displaceable vertically and said links are disposed at an acute angle with respect to the horizontal and approach the horizontal as the holders are displaced towards one another.

4. Apparatus as claimed in claim 2 comprising a press for applying force to said wedge-shaped elements to displace the same and a punch operatively associated with the press for directly applying a force normal to the blank concurrently with the upsetting thereof.

5. Apparatus as claimed in claim 4 comprising upper die inserts constituted as wedges for being driven against said blank.

6. Apparatus as claimed in claim 2 wherein the blank is formed with opposite shoulder portions and a narrowing connection portion, said apparatus further comprising a punch including a portion introducible between said shoulder portions to engage and deform said narrowing connection portion, and lateral portions with surfaces for engaging the shoulder portions.

7. Apparatus for forming blanks for use in the method of claim 1 comprising a ring, a die insert consisting of ring segments disposed within said ring for contacting a necked-down portion of a piece from which the blank is to be formed, said ring and ring segments having conforming oblique surfaces, a ring support slidably supporting said ring segments, and arrester hooks pivotably mounted on said ring for engaging said ring support as said oblique surfaces of said ring engage the oblique surfaces of the ring segments to clamp said segments against the necked-down portion of the piece, said ring support having outward projections for pivotably moving said hooks to allow engagement with the ring support when the ring has engaged said ring segments, said oblique surfaces having angles of inclination greater than the self-braking angle.

* * * * *